United States Patent [19]

Stepp et al.

[11] 4,017,788

[45] Apr. 12, 1977

[54] PROGRAMMABLE SHUNT VOLTAGE REGULATOR CIRCUIT

[75] Inventors: Elvin Duane Stepp, Cincinnati, Ohio; James Reggie Talley, Dallas, Tex.

[73] Assignee: Texas Instruments Incorporated, Dallas, Tex.

[22] Filed: Nov. 19, 1975

[21] Appl. No.: 633,527

[52] U.S. Cl. ..... 323/8; 323/22 T; 323/69

[51] Int. Cl.[2] ..... G05F 1/58

[58] Field of Search ..... 323/8, 16, 17, 22 T, 323/38, 68, 69

[56] References Cited

UNITED STATES PATENTS

| | | | |
|---|---|---|---|
| 2,850,695 | 9/1958 | Bishop | 323/8 |
| 3,828,241 | 8/1974 | Horichi | 323/8 |
| 3,851,241 | 11/1974 | Wheatley, Jr. | 323/8 |

*Primary Examiner*—Gerald Goldberg
*Attorney, Agent, or Firm*—Harold Levine; James T. Comfort; James O. Dixon

[57] ABSTRACT

A shunt regulator circuit having a reference voltage generator in which the collector currents of a pair of transistors are adjusted by the ratios of their load resistances to produce a temperature coefficient equal and opposite to the temperature coefficient of third transistor; a proportional sample of the output voltage is compared to the temperature stable reference voltage to adjust the shunt current to maintain the output voltage constant.

9 Claims, 2 Drawing Figures

PROGRAMMABLE SHUNT VOLTAGE REGULATOR CIRCUIT

Figure 1:
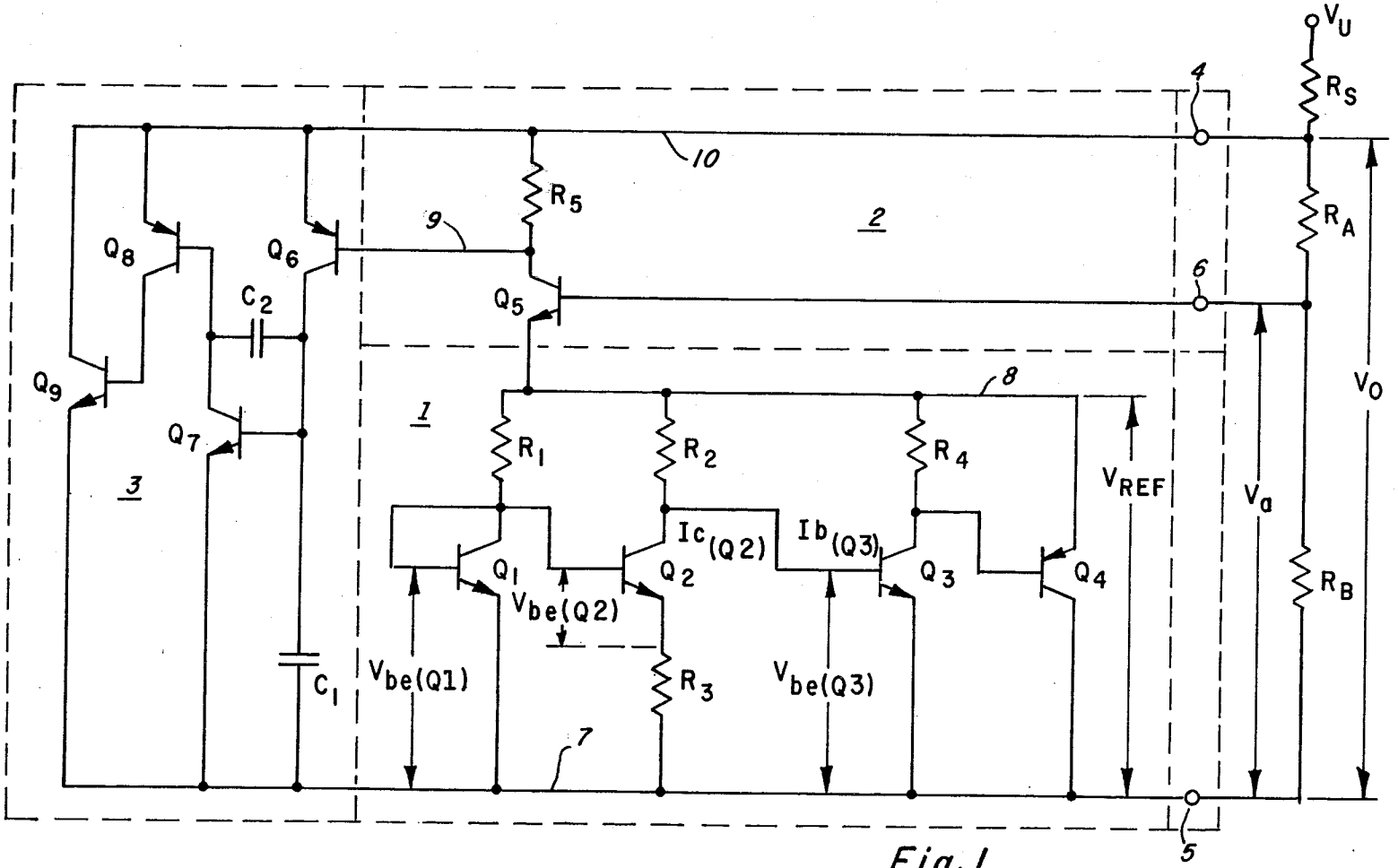

Often in electronic circuits it is desirable to hold an operating circuit supply voltage constant while supplying load currents from it which may vary over a substantial range. So called shunt regulators are often used for this purpose. A prior art example of a shunt regulator is the well known zener diode. The ideal characteristic of a zener diode is that no current will flow through the device until the supply voltage across its terminals reaches a specified threshold. At the threshold or breakdown voltage current begins to flow through the diode. Thereafter the voltage drop across the diode will remain constant over a wide range of current variations through the diode.

Thus, when a zener diode is connected across the voltage supply terminals of an operating circuit any tendency for the supply voltage to increase because of a drop in the current demand by the operating circuit is counteracted by an increased current flow through the diode and the supply voltage is prevented from rising above the breakdown voltage of the zener diode.

Zener diode characteristics can be approximated by a transistor having its output terminals connected across the supply voltage lines and its input terminals connected to the junction of a pair of resistors connected in series across the supply lines as a voltage divider. In a variation of such a transistor shunt regulator the output terminal of an opposite type transistor is connected between the input terminal of the first transistor and one of the supply lines with its input terminal connected to the junction of the voltage divider resistors.

All of the above mentioned shunt regulators are very sensitive to temperature variations because of their dependence on the breakdown voltage of p-n junctions which experience relatively large changes with temperature changes. Further, zener diodes are limited to the specific "knee voltage" or breakdown value for which they are designed and this breakdown is electrically quite noisy.

In the programmable shunt regulator circuit of the present invention the "knee voltage" is continuously variable from about 2.5 volts to about 150 volts; its temperature coefficient is typically less than 100 parts per million per degree Celsius or very nearly zero. Further, since the regulator circuit of the present invention does not operate in the "breakdown" mode its operation is much less noisy than a zener diode and its "on" resistance is much less.

In one embodiment the programmable shunt regulator circuit of the present invention comprises a four transistor four resistor voltage reference section, a single transistor error amplifier and a four transistor active power amplifier section. In the voltage reference section the respective collector currents of a pair of transistors are established to produce a positive temperature coefficient for the pair which cancels the negative temperature coefficient effects of the third transistor of the section.

It is one object then of the present invention to provide a three terminal programmable shunt regulator circuit having a near zero temperature coefficient.

It is a further object of the present invention to provide a three terminal programmable shunt regulator circuit wherein the "knee voltage" is continuously variable over a range from about 2.5 volts to about 150 volts.

It is a still further object of the present invention to provide a three terminal programmable shunt regulator circuit in which operation produces less circuit noise then zener diode devices performing a comparable function.

It is also an object of the present invention to provide a three terminal programmable shunt regulator circuit in which the "on" or shunt resistance is significantly lower than the resistance of a zener diode performing a comparable function.

Figure 2:
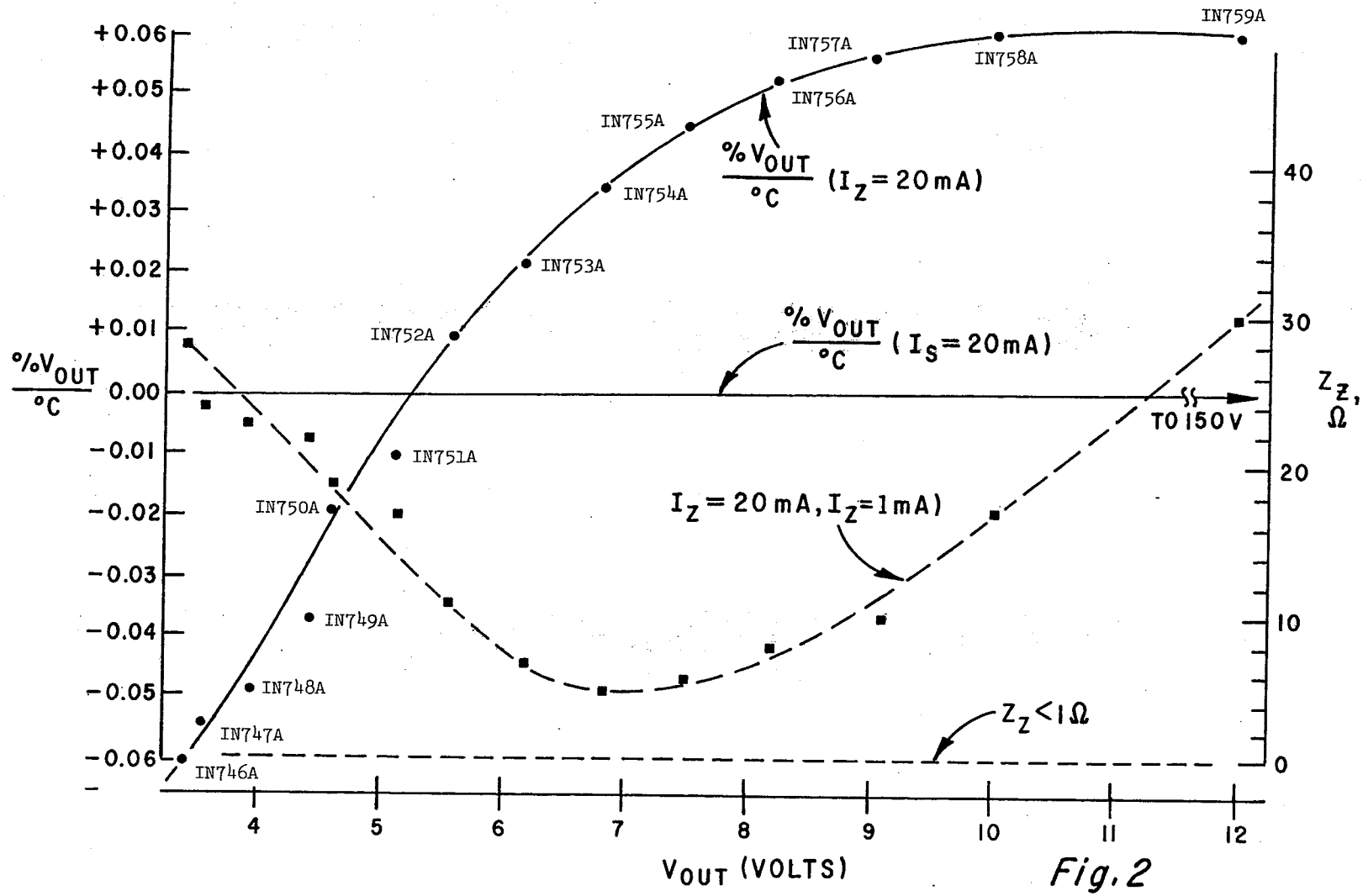

These and other objects and advantages of the present inventions will become apparent from the following detailed description taken in conjunction with the accompanying drawings in which:

FIG. 1 is a schematic diagram of the circuit of one embodiment of the shunt regulator of the present invention, and FIG. 2 is a graph illustrating the temperature coefficient and impedance characteristics of typical commercially available zener diodes as compared to those with the shunt regulator circuit of the present invention.

With specific reference now to FIG. 1 there is shown a schematic diagram of one embodiment of the shunt regulator circuit of the present invention. The shunt regulator circuit is comprised of the voltage reference section 1, the error voltage amplifier section 2 and the active power amplifier section 3. The voltage to be regulated, $V_U$, is applied through a suitable series resistor, $R_S$, across the terminals 4 and 5. A sample voltage, $V_A$, proportional to the desired regulated output voltage, $V_O$, is applied between terminals 5 and 6. This sample voltage may be generated from a voltage divider comprising resistors $R_A$ and $R_B$ in series across the voltage $V_O$.

The voltage reference section 1 comprises transistors Q1 through Q4 and resistors R1 through R4. Transistor Q1 has its emitter terminal connected to terminal 5 through line 7 and its base and collector terminals connected together and to the reference line 8 through resistor R1. Transistor Q2 has its emitter terminal connected to line 7 through resistor R3, its base terminal connected to the collector of transistor Q1 and its collector terminal connected to the voltage reference line 8 through resistor R2. The emitter terminal of transistor Q3 is connected to line 7, the base terminal of transistor Q3 to the collector terminal of transistor Q2 and the collector terminal of transistor Q3 is connected to voltage reference line 8 through resistor R4. Transistor Q4 is connected between voltage reference line 8 and line 7 with its emitter terminal to line 8 and its collector terminal to line 7. The base terminal of transistor Q4 is connected to the collector of transistor Q3.

The resistors R1 through R4 are so proportioned in value that the combination of transistors Q1 and Q2 has a temperature coefficient which is positive and sufficient to offset the negative temperature coefficient of transistor Q3. More specifically, with transistors Q1 and Q2 operating at different collector currents the difference in their $V_{BE}$'s (base-emitter drops), which is designated herein as $\Delta V_{BE}$, has a positive temperature coefficient which can act to compensate the negative temperature coefficient of the $V_{BE}$ of transistor Q3.

Assuming then that the ratios of the resistor values do not change with temperature, the voltage drop between lines 7 and 8 may be selected to have a positive temperature coefficient that will compensate the negative temperature coefficient of the $V_{BE}$ of transistor Q5 and hold the voltage between lines 6 and 7 constant over a wide temperature range. Transistor Q4 acts to reduce the impedance seen at the $V_{REF}$ node (line 8) and hence reduces the sensitivity of the voltage reference section to current variations.

This reference voltage $V_{REF}$ is applied to the emitter terminal of the transistor Q5 of the error voltage amplifier section 2. Resistor R5 is a load resistor connecting the collector terminal of transistor Q5 to the supply voltage at terminal 4. As can be seen, the sample voltage at terminal 6, which is directly proportional to the output voltage at terminal 4, is applied to the base of transistor Q5. The voltage on the base of transistor Q5 is thus compared to the temperature stabilized reference voltage on line 8 which is applied to the emitter of transistor Q5. The output on line 9 from the collector of transistor Q5 is then an amplified version of the error voltage generated by the voltage variations in the supply as compared to the reference voltage.

The signal on line 9 which is indicative of the output voltage of the system compared to the stable reference voltage, is applied to the active power amplifier 3 by way of the base terminal of transistor Q6. In addition to transistor Q6 the active power amplifier section 3 comprises transistors Q7, Q8 and Q9 together with capacitors C1 and C2. As can be seen from the drawing, the emitter terminals of Q6 and Q8 and the collector terminal of transistor Q9 are connected to the output voltage terminal 4 through line 10. The emitter terminals of transistors Q7 and Q9 are connected to terminal 5 through line 7. The collector terminals of transistors Q6, Q7 and Q8 are connected to the base terminals of transistors Q7, Q8 and Q9 respectively. When connected thusly the transistors of the active power amplifier section 3 turn "on" when the error amplifier Q5 just begins to conduct indicating that the output voltage $V_O$ is tending to increase. Thus, $V_A$ is held exactly one $V_{BE}$ above the $V_{REF}$ on line 8. Capacitors C1 connected between the base of transistor Q7 and line 7 and C2 connected between the collectors of transistors Q6 and Q7 provide stability to the circuit.

The relationships in the circuit may be expressed mathematically as follows:

In the voltage reference section:

$$V_{REF} = V_{BE(Q3)} + I_{C(Q2)}R_2 + I_{B(Q3)}R_2 \quad (1)$$

$$I_{C(Q2)} = (V_{BE(Q1)} - V_{BE(Q2)})/R_3 = (\Delta V_{BE}/R_3) \quad (2)$$

$$V_{REF} = V_{BE(Q3)} + (\Delta V_{BE}/R_3)\, R_2 + I_{B(Q3)}R_2 \quad (3)$$

$\Delta V_{BE}$ is proportional to current densities $J_1$ and $J_2$ in the emitters of $Q_1$ and $Q_2$, respectively.

$$V_{REF} = V_{BE(Q3)} + \frac{\frac{kT}{q}\ln\frac{J_1}{J_2}}{R_3} R_2 + I_{B(Q3)}R_2 \quad 4.$$

For adequate current gains in transistors Q1 and Q2, $I_{B(Q3)}$ may be neglected and since $(J_1/J_2) = (R_2/R_1$, equation 4 becomes:

$$V_{REF} = V_{BE(Q3)} + \frac{R_2}{R_3}\left(\frac{kT}{q}\ln\frac{R_2}{R_1}\right) \quad 5.$$

In the error amplifier section:

$$V_A = V_O \frac{R_B}{R_A + R_B} \quad 6.$$

$$V_O = V_A\left(1 + \frac{R_A}{R_B}\right) \quad 7.$$

$$V_A = V_{BE(Q5)} + V_{REF} \quad (8)$$

$$V_O = (V_{BE(Q5)} + V_{REF})\left(1 + \frac{R_A}{R_B}\right) \quad 9.$$

Substituting from equation 5

$$V_O = \left(V_{BE(Q5)} + V_{BE(Q3)} + \frac{R_2}{R_3}\,\frac{kT}{q}\ln\frac{R_2}{R_1}\right)\left(1 + \frac{R_A}{R_B}\right) \quad 10.$$

Since it is reasonable to assume that the ratios $(R_2/R_3)$ and $(R_2/R_1)$ do not change with temperature it can be seen that the term $(R_2/R_3)$ $(kT/q)$ ln $(R_2/R_1)$ by the proper choice of $R_1$, $R_2$ and $R_3$ can be made to have a positive temperature coefficient which will just cancel the negative temperature coefficients of $V_{BE(Q5)}$ and $V_{BE(Q3)}$. Thus, $V_O$ may be selected to be positive, negative or zero temperature coefficient.

In the circuit of FIG. 1 the following component values achieved a zero temperature coefficient for $V_O$ when the temperature coefficients for $V_{BE}$'s of Q3 and Q5 were -2mV/°C.

| | |
|---|---|
| R1 = 2.7KΩ | $R_A$ = 21KΩ |
| R2 = 82KΩ | $R_B$ = 10.2KΩ |
| R3 = 5.6KΩ | Cl = 47 pf |
| R4 = 7.8KΩ | C2 = 47 pf |
| R5 = 700Ω | |

The graph of FIG. 2 compares the temperature coefficients, curve 20 left hand ordinate, and small signal impedances, curve 21, right hand ordinate, plotted as a function of output voltage for several commercially available zener diodes with the same parameters, curves 22 and 23 respectively of the voltage regulator circuit of the present invention.

Thus, there has been disclosed a programmable shunt regulator circuit having a selectable temperature coefficient which may be selected to be near zero, a "knee voltage" variable over a range of about 2.5 to 150 volts and a low internal resistance.

Many changes and modifications to the circuit of the present invention will be obvious to those skilled in the art and therefore the examples disclosed are not to be considered as exhaustive of this invention which is limited only as set forth in the following claims.

What is claimed is:

1. A shunt regulator circuit having an output terminal, a sample voltage terminal and a common terminal and comprising:

a. a reference voltage generator means having a pair of transistors driving a third transistor, each with load resistors, said load resistors being so proportioned in resistance value with respect to each other that the combined temperature coefficients of said pair of transistors is equal and opposite the temperature coefficient of said third transistor;

b. an error voltage amplifier means receiving the output of said reference voltage generator means and a voltage from said sample voltage terminal and producing in response thereto an output indicative of any deviation of the voltage between said output terminal and said common terminal from a predetermined desired value; and c. an active power amplifier means responsive to the output of said error voltage amplifier means to produce a change in the current through said power amplifier means whereby the voltage between said output terminal and said common terminal remains constant at said predetermined desired value.

2. A shunt regulator circuit as defined in claim 1 wherein said pair of transistors have their bases connected together and to the collector of the first transistor of said pair and through a first load resistor to the output of said reference voltage generator means, the collector of the second of said pair of transistors is connected to the base of said third transistor and through a second load resistor to the output of said reference voltage generator means, and the emitter of said second of said pair of transistors is connected through a third load resistor to said common terminal and to the emitters of said third transistor and the first of said pair of transistors.

3. A shunt regulator circuit as defined in claim 1 wherein said error amplifier means comprises a transistor with its emitter connected to the output of said reference voltage generator, its base connected to said sample voltage terminal and its collector connected to the output of said error voltage amplifier means.

4. A shunt regulator circuit as defined in claim 2 wherein said error amplifier means comprises a transistor with its emitter connected to the output of said reference voltage generator, its base connected to said sample voltage terminal and its collector connected to the output of said error voltage amplifier means.

5. A shunt voltage regulator circuit as defined in claim 1 wherein said active power amplifier section comprises a transistor with its emitter-collector circuit connected between said output terminal and said common terminal and its base coupled to the output of said error amplifier means.

6. A shunt voltage regulator circuit as defined in claim 4 wherein said active power amplifier section comprises a transistor with its emitter-collector circuit connected between said output terminal and said common terminal and its base coupled to the output of said error amplifier means.

7. A shunt voltage regulator circuit as defined in claim 1 wherein said predetermined desired value of said voltage between said output terminal and said common terminal is between about 2.5 volts and about 150 volts.

8. A shunt voltage regulator circuit as defined in claim 4 wherein said predetermined desired value of said voltage between said output terminal and said common terminal is between about 2.5 volts and about 150 volts.

9. A shunt voltage regulator circuit as defined in claim 6 wherein said predetermined desired value of said voltage between said output terminal and said common terminal is between about 2.5 volts and about 150 volts.

* * * * *